US006685133B1

(12) United States Patent
Kojo et al.

(10) Patent No.: US 6,685,133 B1
(45) Date of Patent: Feb. 3, 2004

(54) METHOD AND DEVICE IN CONTINUOUSLY OPERATED UNWINDING OF A PAPER REEL

(75) Inventors: Teppo Kojo, Mäntsälä (FI); Janne Veräjänkorva, Espoo (FI); Petteri Lannes, Jokela (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/937,883

(22) PCT Filed: Mar. 27, 2000

(86) PCT No.: PCT/FI00/00251

§ 371 (c)(1),
(2), (4) Date: Oct. 1, 2001

(87) PCT Pub. No.: WO00/61482

PCT Pub. Date: Oct. 19, 2000

(30) Foreign Application Priority Data

Mar. 30, 1999 (FI) ..... 990701

(51) Int. Cl.[7] ..... B65H 26/00

(52) U.S. Cl. ..... 242/563

(58) Field of Search ..... 242/534, 563, 242/551, 555, 563.1, 563.2

(56) References Cited

U.S. PATENT DOCUMENTS

| | | | | | |
|---|---|---|---|---|---|
| 1,149,018 | A | * | 8/1915 | Beregh | 242/563 |
| 3,427,723 | A | * | 2/1969 | Leckey et al. | 33/554 |
| 3,650,036 | A | | 3/1972 | Coveney et al. | |
| 3,869,770 | A | * | 3/1975 | McCullough | 242/563 |
| 3,971,956 | A | * | 7/1976 | Jakeman et al. | |
| 4,391,417 | A | * | 7/1983 | Gronbech | 242/563 |
| 4,620,184 | A | | 10/1986 | Nedstedt | |
| 4,913,366 | A | | 4/1990 | Andou | |
| 5,248,109 | A | * | 9/1993 | Berger et al. | 242/563 |
| 5,308,010 | A | * | 5/1994 | Hakiel | 242/534 |
| 5,535,627 | A | * | 7/1996 | Swanson et al. | 73/597 |
| 5,778,551 | A | * | 7/1998 | Herklotz et al. | 33/551 |
| 6,095,452 | A | * | 8/2000 | Leskinen | 242/534 |

* cited by examiner

*Primary Examiner*—William A. Rivera
(74) *Attorney, Agent, or Firm*—Steinberg & Raskin, P.C.

(57) ABSTRACT

The invention relates to a method in continuous unwinding of a paper web, in which a paper reel (3) wound on a reeling core (2) or the like is unwound by rotating the same to guide the paper web (1) to a further processing stage. The method is characterized in that the shape of the outer surface of the unwound paper reel (3) is measured with the aim of detecting the defects possibly occurring in the paper reel (3) the invention also relates to an apparatus for applying the method.

22 Claims, 5 Drawing Sheets

METHOD AND DEVICE IN CONTINUOUSLY OPERATED UNWINDING OF A PAPER REEL

The invention relates to a method in continuously operated unwinding of a paper reel, in which a paper reel wound on a reeling core or the like is unwound by rotating the same to guide the paper web to a further processing stage.

In particular, the target of application of the method is a method used in connection with the unwinding of so-called machine reels which are full and reeled up on the reeling core from a full-width web. Naturally, the invention is not restricted solely to the above-mentioned embodiment, but it can be applied in unwinding in general as well as for collecting information process during the reeling up process for enhancing the control of the unwinding.

It is economically reasonable to try to unwind all the paper web that has been reeled up and to guide it to a further processing stage, such as supercalendering, coating machine or printing machine, etc. On the other hand, a successful further processing of the paper web requires the paper reel that has been reeled up to be of good quality, in other words the paper web passed from the paper reel that is being unwound is of such good quality that further processing can be successful and disturbances or breaks do not occur.

On the other hand, especially when conventional reeling up techniques are utilized in the reeling of thin paper grades (weight max. 60 g/m$^2$) in particular, it is possible that due to the conditions of the reeling process, for example the low tension of the paper web, there are local changes deviating from the circular form of the cross section of the paper reel, typically protrusions in the direction of the radius, which result from local wrinkling of the paper web or from tearing of the paper web. Such mechanical defects occurring in the paper web that is being reeled up cause the breaking of the paper web, at the worst, or at least problems at the further processing stage, if they are not taken into account. The occurrence of the aforementioned defects which are effective in the unwinding of the paper web may be caused by various factors, or by cooperation of the same. Such factors include e.g. the paper grade, grammage of the paper, friction factor of the paper web, diameter of the paper reel, tightness of the paper reel, condition of the reeling core, as well as the dimensions of the reeling core. Because the number of effective factors is as large as it is,there may be occasional variations in the quality properties of the paper reel, especially in the bottom area of the paper reel. This contingency has caused problems especially when the aim is to attain continuous unwinding i.e. good runnability, in other words to avoid breaks. Because of occasional defects in the quality of the paper reel, part of the bottom area of the paper reel is left unwound, to avoid problems caused by occasionally occurring defects in the paper reel. Typically 2 to 5% of the unwound paper reel is thus not utilized at the further processing stage.

It is an aim of the present invention to solve the above-described range of problems in such a manner that during the unwinding process, the entire defectless part of the paper reel can be guided to further: processing, at the same time ensuring that said paper reel does not contain defects originating from the reeling up process impairing the quality of the paper web that is being unwound. If such defects occur, they can be detected and analysed at such an early stage that .e.g. the continuous unwinding can be maintained by slowing down the further processing and unwinding stages (the defect is passed by cautiously), by guiding the defect point past the further processing stage or by changing the paper reel to be unwound.

To attain these objectives, the method according to the invention is primarily characterized in that the shape of the outer surface of the paper reel is measured, advantageously in the cross-sectional plane of the paper reel. The cross-sectional plane of the paper reel refers to the plane preferably perpendicular to the longitudinal direction of the central axis of the paper reel. By measuring the shape of the outer surface of the paper reel, it is possible to attain information on the local changes in the radius/diameter of the paper reel that is being unwound, which changes are then compared to a reference level prevailing at the moment, such as the average value of the radius/diameter.

Surprisingly, it has been observed in this invention that a defect generated during the reeling up of the paper reel, especially a defect occurring in the edge areas of the paper reel, affecting the quality of the paper web, can be detected from the paper reel that is being unwound well before the point of the web in question becomes unwinded. Such a defect shows up in the shape of the cross-section of the paper reel several laps before it enters the unwinding stage, as a point of discontinuity which is local, periodical or occurs in a given angular sector and can be detected. The observation related to the occurrence of the defect point can be analysed immediately by means of a computer, and on the basis of this analysis it is possible to give the necessary instructions to the unwinding and further processing stages, for example according to a predetermined strategy of action.

The other dependent claims present some advantageous embodiments of the method according to the invention.

The invention also relates to an apparatus in continuous unwinding of a paper reel, in which a full paper reel wound on a reeling core or the like is arranged to be unwound by rotating the same to guide the paper web to a further processing stage. The apparatus according to the invention is primarily characterized in that the apparatus comprises means for measuring the shape of the cross-section of the paper reel.

The other dependent claims present some advantageous embodiments of the apparatus according to the invention.

The following description illustrates in more detail the method and apparatus according to the invention with reference to the appended drawings. In the drawings.

Figure 1:
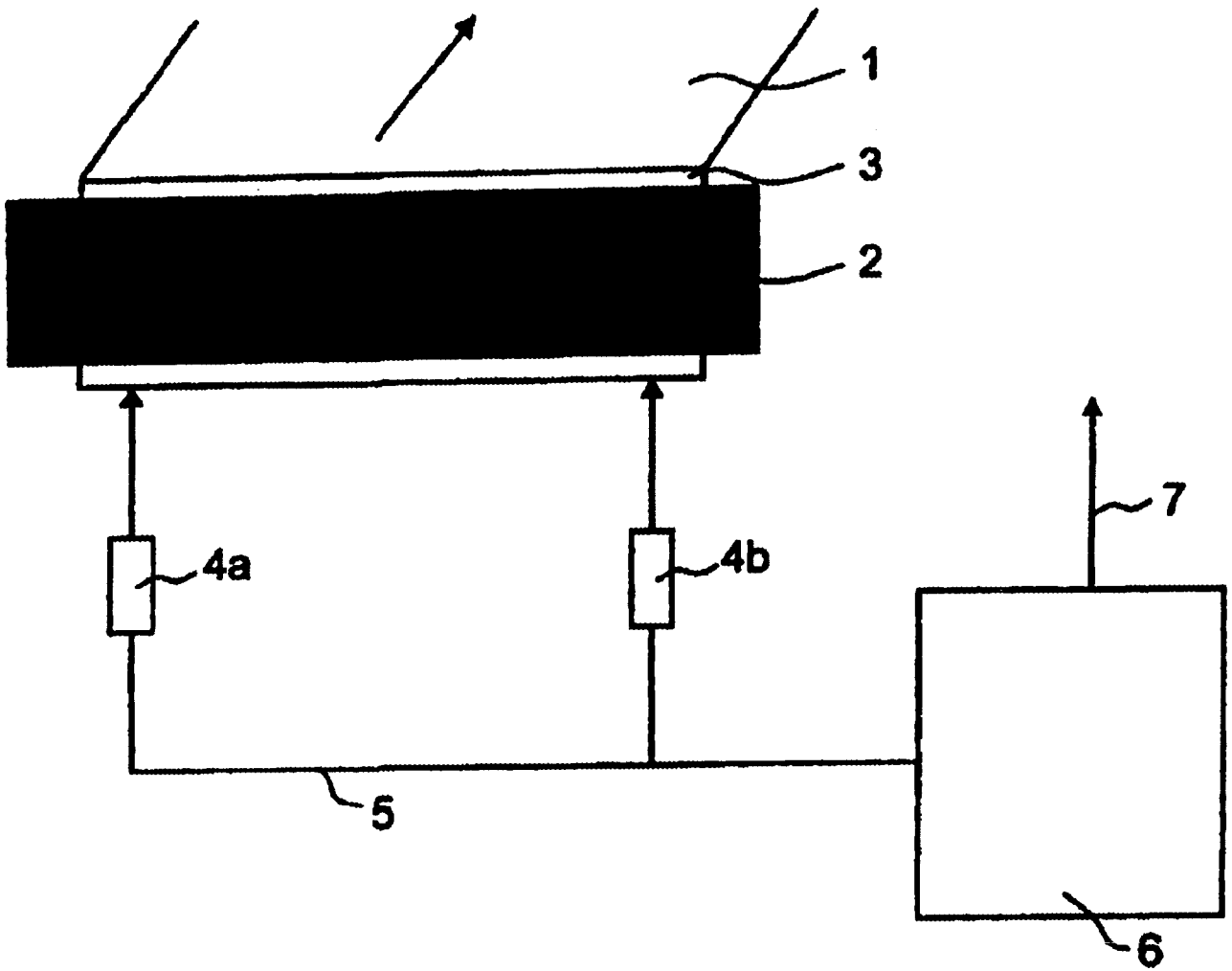
FIG. 1 shows schematically a first embodiment of an apparatus applying the method according to the invention.
Figure 2:
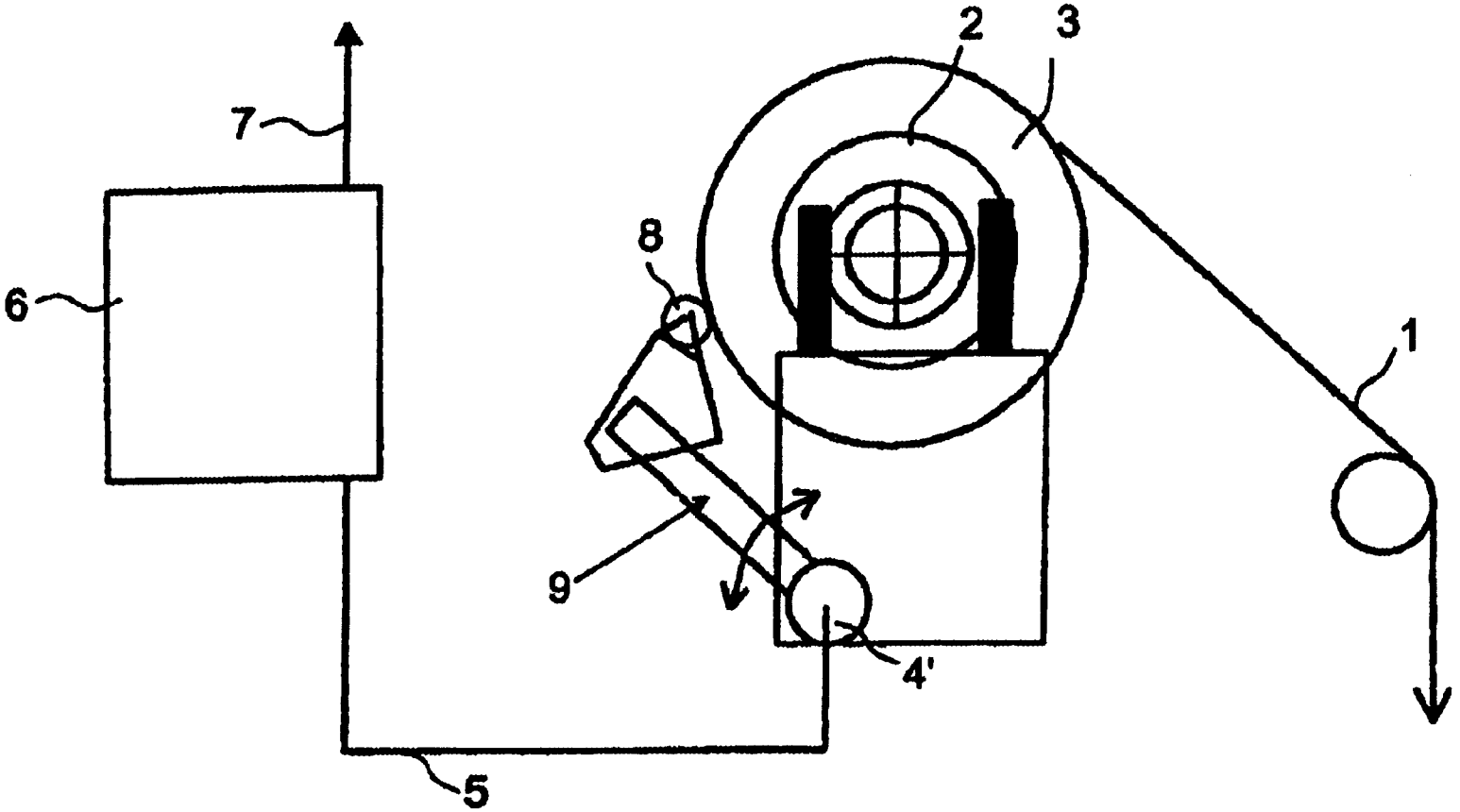
FIG. 2 shows schematically a second embodiment of an apparatus applying the method according to the invention, [and]

According to FIGS. 1 and 2, a paper web 1 is unwound from a paper reel 3 reeled on a reeling core 2. The paper web 1 is guided to further processing from the reeling core.

According to the basic idea of the invention and with reference to FIG. 1, members 4*a*, 4*b* are placed in connection with the paper reel 3 that is being unwound, the members being utilized to measure the shape of the cross-section of the paper reel 3 that is being unwound. Preferably, the measurement takes place in the cross-sectional plane, which is perpendicular to the central axis of the rotating movement of the reeling core. In the embodiment of FIG. 1, the members 4*a* and 4*b* are distance meters functioning on the non-contacting measurement principle, such as laser meters or microwave radars. It should be noted that this embodiment presents two members 4*a*, 4*b* as examples. There may be a larger number of them, or only one which covers a suitably wide area on the surface of the paper reel.

In the embodiment of FIG. 1, the members 4*a*, 4*b* measuring the shape of the cross-section of the paper reel 3 that is being unwound, are divided into two groups and positioned to measure the shape of the cross-section simultaneously from two points in the paper reel 3 that is being unwound. The defects generated in the reeling up of the paper reel 3 typically occur in the edge areas of the paper reel, and thus it is advantageous to place the distance measurement at least in these edge areas, e.g. within a distance of 10 cm from both ends of the paper reel 3. According to the width of the paper reel 3 it is possible to extend the measurement as far as 1500 mm from said end.

Another alternative is to arrange a fast, scanning measurement to extend e.g. within an area of one meter from both ends of the paper reel 3 that is being unwound.

The method according to the invention can, in addition to the non-contacting embodiment shown in FIG. 1, also be applied by means of contacting measuring method according to the apparatus embodiment shown in FIG. 2. The member for conducting the contacting measurement can be for example a roll 8 rotating against the surface of the paper reel 3, which roll is loaded slightly against the outer surface of the paper reel 3. Thus, the periodical, growing, local and temporary deviation (see FIG. 3) in the diameter of the paper reel occurs as a periodical, accelerating movement of the roll 8 i.e. as an oscillation of a particular kind. This can be detected for example by providing the support 9 of the roll 8 with an acceleration sensor 4' or another suitable sensor from which a signal can be conveyed to a computer 6 via a line 5. The roll 8 or the like can be full in width, or merely at lest one pair of rolls placed on the edge area, and if the signal in question, for example, is a signal that triggers a web change in a coating machine, the location of the defect in the roll (in the cross direction) is not actually significant, but the fact that the web change is conducted before the defect point enters the coating station thereby causing a web break. The aim is to conduct the web change at a normal running speed, i.e. by means of a so-called flying change as shown in FIG. 4. FIG. 4 shows the tape splice (SP) used in connection with the flying change or the flying, splice process.

With reference to both, FIGS. 1 and 2, the measurement information from the distance measurement meters 4*a*, 4*b* (FIG. 1) and/or from the sensor 4' (FIG. 2; it is obvious that the embodiments according to FIGS. 1 and 2 can also be used as a combination), is transferred along the line 5 to the computer 6, in which the measurement information is analysed. The necessary signals are transferred from the computer to a process control system along a line 7.

The act of processing the measurement information as well as the detection of defects takes place either by directly monitoring the measurement signal, or by producing a frequency spectrum from the signal.

The direct monitoring of the measurement signal is based on the recognition of the signal shape (temporal shape of the pulse, i.e. duration and amplitude), i.e. the signal shape/shapes corresponding to the defect/defects in the paper reel is/are stored in the computer 6, wherein the comparison of the measured signal arriving from the distance meters 4*a*, 4*b* takes place between said measured signal and a signal stored in the memory of the computer and corresponding to said defect in the paper reel, wherein the advantage lies in the fast and accurate reaction according to the defect type.

The monitoring of the frequency spectrum (hereinbelow shortly spectrum), in turn, requires information recorded from several revolutions of the paper reel 3 that is unwound, wherein the time to react to the appearing defect by means of process control is reduced. The advantage attained is that the defect identification accuracy is improved.

Figure 3:
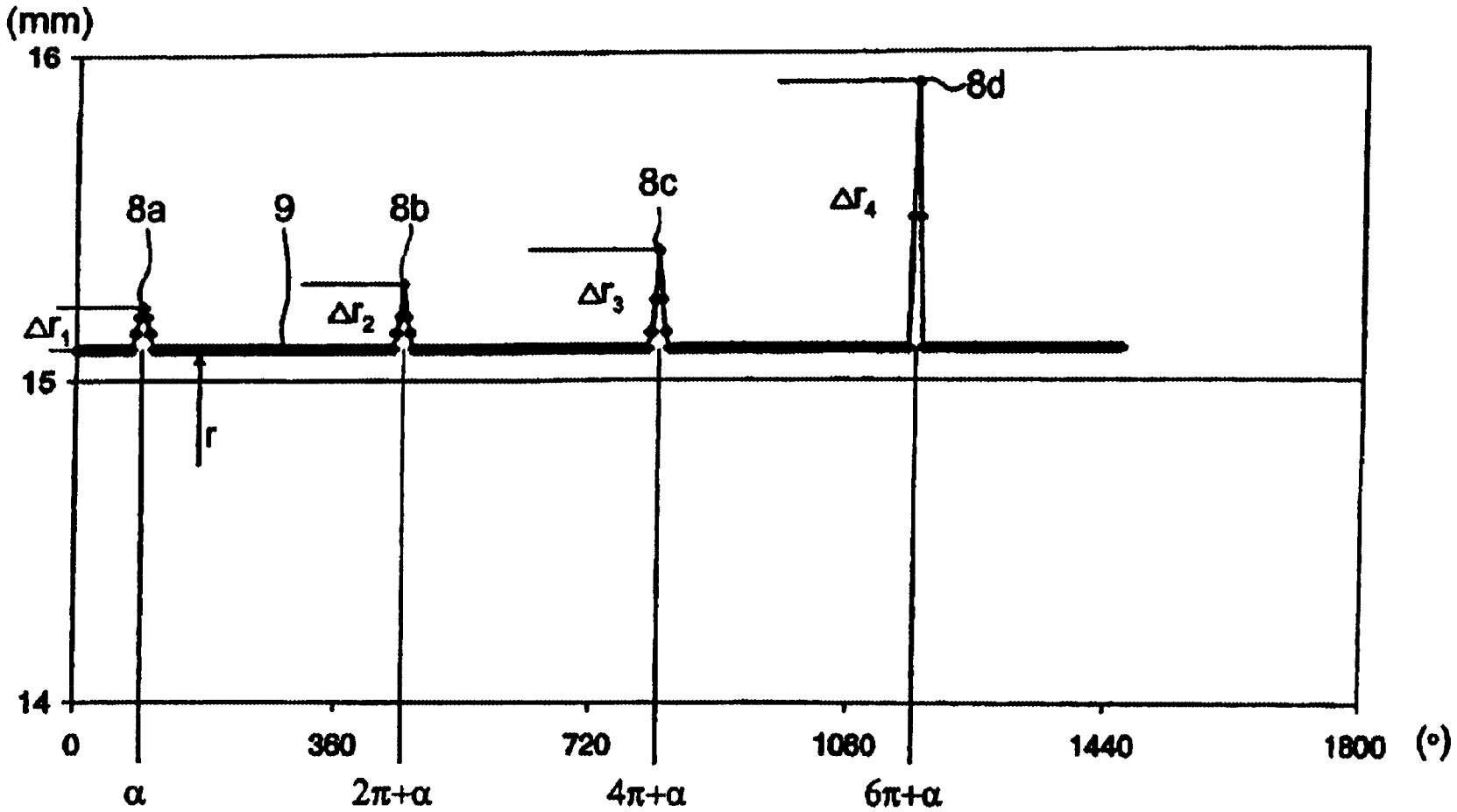
FIG. 3 shows schematically a measurement result attained by means of the apparatus according to the invention.
Figure 4:
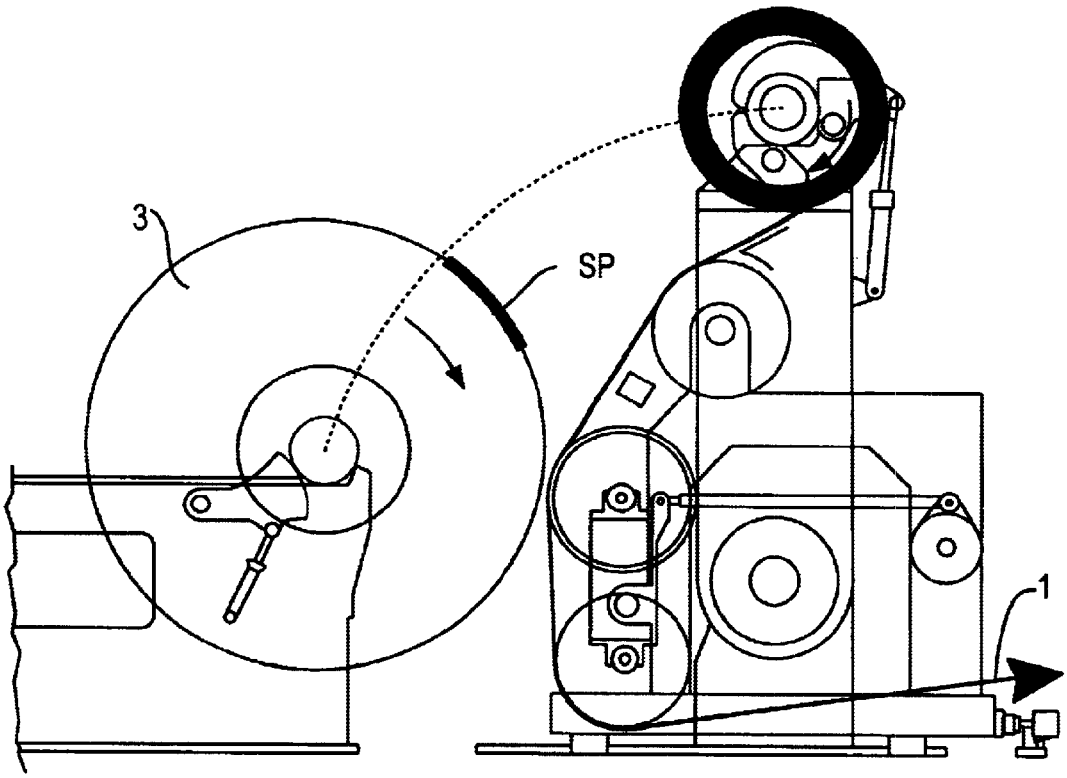
FIG. 4 shows schematically a flyiny splice according to the invention.

FIG. 3 shows schematically the occurrence of the defect in the paper reel 3 in the measurement. In the diagram according to FIG. 3, the vertical axis illustrates the measured distance from the surface of the paper reel 3 to be unwound, and the horizontal axis illustrates the rotational angle of the paper reel. The defect in the paper reel occurs (typically at intervals of 360° ) as a rapid change 8*a*, 8*b*, 8*c* . . . of small angular distance, typically under 6° (10° at the most) in the distance i.e. horizontal line 9, which otherwise remains constant (ideal situation) during the measurement period in question. During the measurement period shown in FIG. 3, the diameter of the paper reel 3 does not have the time to change to such an extent that it would affect the measurement result or the analysis of the same. As can be seen in FIG. 3, the periodical occurrence of the defect becomes stronger when the rotation of the paper reel 3 proceeds, and causes a pulse that becomes stronger and corresponds to a particular change in the diameter of the paper reel (i.e. 8*d* nearly 1 mm), and thereby in the shape of the cross-section, i.e. in the presumed circular shape (deviation in the horizontal line 9).

In FIG. 3 the horizontal line 9 thus describes an ideal situation in which the cross-sectional shape of the paper reel is circular. However, this is not, in practise, always the case. The paper reel can, at least for the part of the outer layers contain depressions developed during the storing and handling, or the cross-section of the paper reel is for example moulded into elliptical shape during the storage. Such "deformations" in the cross-section occur as wide angular sector disturbances in the horizontal line 9, for example as "dents" or wave shapes. Such wide sector disturbances can be calculatorily filtered off, and it is obvious that a local radial change occurring inside such a wide sector disturbance area can be detected.

With reference to the above-mentioned facts it can be stated that the method can be reliably applied if $$\Theta >> \phi, \text{ in which} \tag{1}$$

$\Theta$=a wide sector disturbance or defect in the circular form of the paper reel, and $\phi$=local disturbance or defect in the circular form of the paper reel, i.e. the angle corresponding to such short sector is under 10°, approximately typically smaller than 6°.

$\phi$is in the general format $$\varphi = 360° \times \frac{P}{2\pi R(t)}, \text{ in which} \tag{2}$$

$t$ = time, $P$ = the length of the disturbance or defect in the direction of the perimeter of the paper reel, $\pi$ = 3, 14 … , and $R(t)$ = the radius of the paper reel in the moment of occurrence of the defect or disturbance in question.

In the following, the operating principle of the method according to the invention for detecting local defects is also illustrated by means of the symbols shown in FIG. 3.

During a given measurement period the radius/diameter of the paper reel is reduced very slightly, i.e.

$$\Delta R = n \times PP, \text{ wherein} \quad (3)$$

ΔR=the change in the radius of the paper reel during the measurement period, n=number of rotations of the paper reel taking place during the measurement period, and PP=thickness of the paper web.

Thus, during the, measurement period measurement information is obtained (neglecting ΔR), which measurement information $$Ri(t), \quad (4)$$

can be presented in the format $$R_i(t) = r(t) + \Delta r\ (\alpha, t), \text{ in which} \quad (5)$$

t=time, r(t)=disturbance-free measurement result, reference level i.e. "reference" (horizontal line 9 in FIG. 3), Δr=disturbance or defect in the outer shape of the paper reel, and α=angle in which the disturbance or defect occurs with respect to a given reference angle.

If a short sector radial disturbance or defect occurs by the angle α, it is indicated as a change 8*a*, 8*b*, 8*c* . . . , i.e. the location of the angle α indicates the possibility of short sector disturbance, ϕ=typically smaller than 6°, in any case under 10°.

During a given measurement period information on the "horizontal line 9" i.e. reference is obtained (wide, non-relevant imperfections in the shape of the outer surface are filtered out), i.e. in a situation in which $$\Delta r\ (t) = 0, \text{ and thus when} \quad (6')$$

$$\Delta r\ (\alpha, t) \neq 0, \text{ local disturbance is possible} \quad (6'')$$

$$\text{When the variables } \Delta r_i\ (\alpha, t) \neq 0 \text{ form a series } (i = 1, 2, 3 \ldots) \quad (7)$$

$$\Delta r_1\ (\alpha, t_1) < \Delta r_2\ (\pi + \alpha, t_2) < \Delta r_3\ (4\pi + \alpha, t_3) \quad (8)$$

the disturbance or defect in question is of such a quality that it can be detected by means of the method according to the invention. If the paper reel contains the aforementioned disturbances or defects in two or more points in the perimeter of the paper reel, they can be detected separately on the basis of the periodicality of the formula (8).

Thus, Δr(t)=0 and Δr (t)≠0 are distinguished according to the invention by measuring the shape of the outer surface of the paper reel, advantageously in its cross-sectional plane, wherein it is possible to utilize the rate of change of the measurement signal to determine whether the change is included in the reference level or if it is handled as a local disturbance, in other words, the measurement result belonging to the reference level can, in practice, be Δr (α,t)≠0, if the rate of change is below a predetermined level. More precise determination of these is conducted e.g. on the basis of empirical experiments.

The earlier the system recognizes a disturbance or defect in the paper reel 3 in a reliable manner, the more time the process control system has for action, i.e. for preparing itself to a possible web, for reducing the harmful effects of the possible web break, or even for avoiding the break e.g. by replacing the paper reel that is unwound by a new, full paper reel. For example during supercalendering it is possible to slow down the running speed or reduce the web tension. When the defect is substantial, it is possible to stop the process and pass the defect point in the paper web past the further processing stage, e.g. to a pulper, and to start unwinding and processing again after the defect point has been removed.

Figure 5:
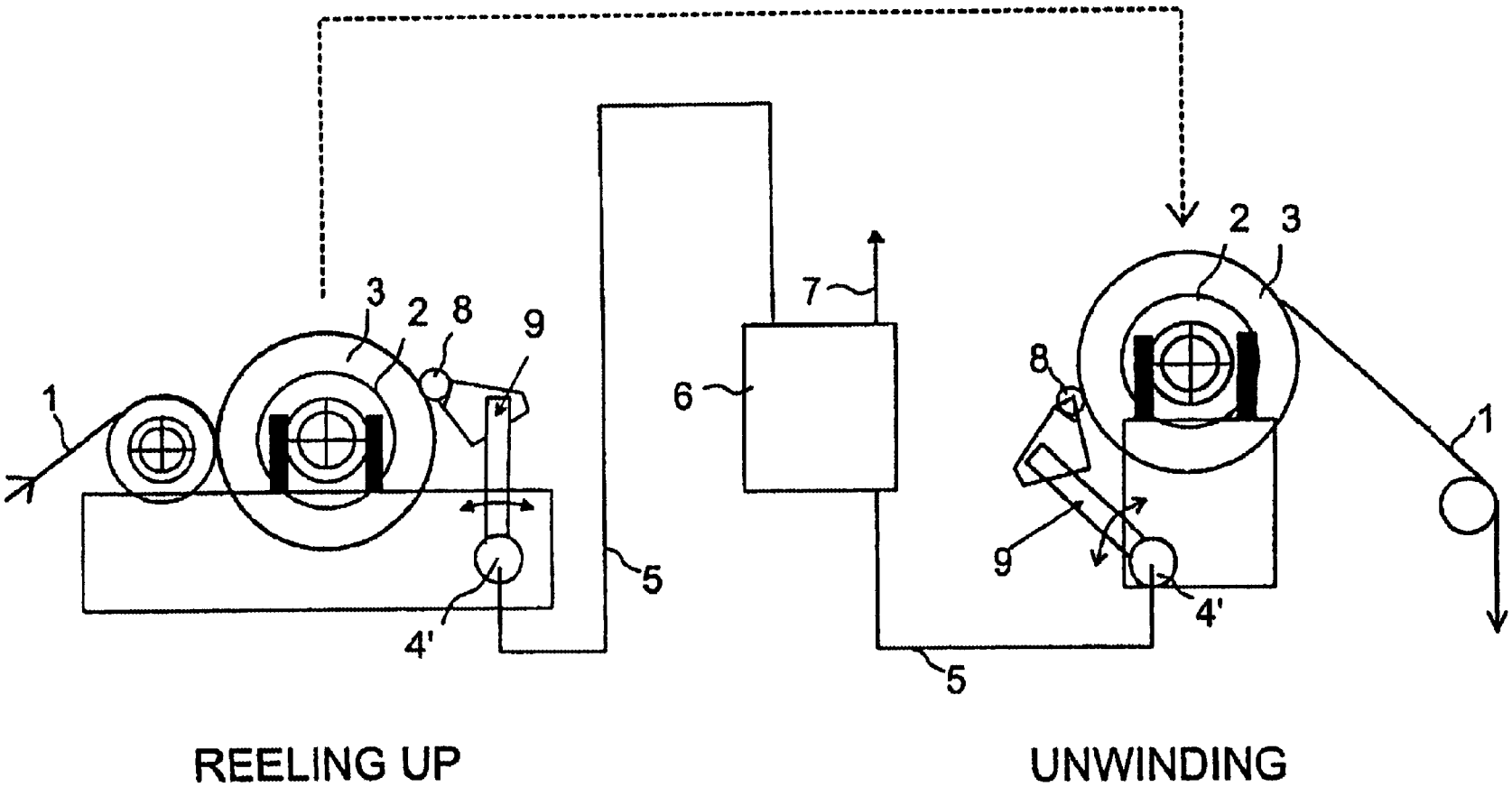
FIG. 5 shows schematically a reeling up process of the paper reel according to the invention.

In addition to the unwinding process, the act of monitoring the shape of the cross-section of the paper reel 3 can be applied also during the reeling up process in a manner described hereinbelow and as shown in FIG. 5. In the reeling up process it is possible to utilize the measurement information collected according to the invention as a function of the amount of paper accumulated on the reeling core 2 of the paper reel 3 in other words the diameter/radius of the paper reel 3, as an aid in the measurement/monitoring according to the invention conducted during the next unwinding process of the same paper reel 3. The information collected in the aforementioned manner during the reeling up process can be used when estimating the probability for that whether the paper reel in question contains reeling defects and further in which point of the unwinding process i.e. the size of the diameter of the paper reel 3 said defects are most likely to occur. Because defects can occur in the paper reel 3 in the reeling up process either in the surface layer/layers reeled at a given time or deeper in the paper reel (i.e. caused by the movement of slack layers with respect to each other), and further, because defects can occur in connection with the handling and/or storing of the full paper reel, taking place after the reeling up, the measurements and monitoring conducted during the unwinding are, however, the primary methods when the aim is to utilize the paper web 1 unwound from the paper reel 3 as efficiently as possible in the further processing stages According to the invention, the measurement of the shape of the cross-section of the paper reel can be implemented either by means of distance meters, such as a laser meter or a microwave radar, functioning on the non-contacting principle, or by means of a contacting measurement method. In addition to the detection of the defects of the paper web in the paper reel, the signal obtained from these measurement devices can naturally also be used for other kind of monitoring of the condition of the unwinding device and/or for monitonng the behaviour of the paper reel that is being unwound by conducting an analysis of the measurement signals in a suitable manner. For example a failure occurring in the bearing arrangement enabling the rotation of the reeling core 2 can be detected by measurements taken from the surface of the unwound paper reel 3, by means of vibrations caused by said bearing arrangement failure in said reeling core and further in said unwound paper reel. The vibrations detected on the surface of the paper reel can also be transmitted from other failured parts which are located elsewhere in the unwinding apparatus, either in the vicinity of the paper reel 3 or further apart from said paper reel. Such failured parts can be for example different supporting rolls or the bearing arrangements of the same, or the bearing arrangements and/or drives of other rotating or linearly moving members. By conducting a suitable vibration analysis for the measurement signals obtained from the measurement members (4*a*, 4*b*; 4'), it is possible to distinguish e.g. vibrations caused by a failure in the bearing arrangement, which typically are indicated at higher frequencies than the signals caused by the reeling defect of the paper web. Correspondingly, it is also possible to detect sudden signals of high amplitude, caused by a swinging and bouncing movement of the paper reel to be unwound, wherein the unwinding process can be rapidly and, if necessary, automatically interrupted for the sake of safety and more substantial damages can be avoided.

What is claimed is:

1. A method in continuous unwinding of a paper web from a paper reel including a core on which the web has been wound, comprising the steps of:

unwinding said paper web by rotating said paper reel;

measuring the radial shape of an outer surface of said paper reel in a plane perpendicular to an axis of said reel, during said unwinding step; and guiding said paper web from said paper reel to a processing stage.

2. The method according to claim 1, wherein the radial shape of said outer surface is measured from at least two axial points of location.

3. The method according to claim 1, wherein the shape of said outer surface of the paper reel is measured from at least two axial points of location, which are positioned at ends of the paper reel.

4. The method according to claim 1, wherein the shape of said outer surface of the paper reel is measured from at least two axial points of location, which are positioned less than 1500 mm from ends of the paper reel.

5. The method according to claim 1, wherein local changes in the radial shape of the outer surface of the paper reel occurring over a sector of the circumference of the reel are observed.

6. The method according to claim 5, wherein the sectoral changes observed where the change in the radial shape of the outer surface of the paper reel for a single disturbance occurs within a sector angle of less than about 10°.

7. The method according to claim 5, wherein after detecting a local change occurring in the radial shape of the outer surface of the paper reel performing at least one of the following actions: reducing the running speed of the paper web and reducing the tension of the paper web.

8. The method according to claim 1, wherein the measuring of the radial shape of the outer surface of the unwound paper reel is conducted with the aim to detect the increases of a series:

$$\Delta r_i(\alpha,t)\neq 0 \tag{7}$$

at angular intervals $2\pi$, in which t=time,

I=1,2,3 , . . .

$\Delta r$=local radial change in the "reference value", and $\alpha$=observation angle of $\Delta r_i$, wherein thus $$\Delta r_1(\alpha,t_1)<\Delta r_2(\pi+\alpha,\ t_2)<\Delta r_3(4\pi+\alpha,\ t_3) \tag{8}$$

and wherein the "reference value" is selected so that it fulfils a condition $$\Delta r(t)=0 \tag{6'}$$

9. A method as recited in claim 1, comprising the further steps of:

prior to said unwinding step, winding said paper web on to a core to form a paper reel;

during said winding step, initially measuring the radial shape of an outer surface of said paper reel, as a function of the amount of paper accumulated, in the plane perpendicular to the axis of said reel; and during said unwinding step, utilizing said initial measurement in said measurement of the radial shape of the outer surface of the paper reel.

10. The method according to claim 1, wherein after detecting a local change occurring in the radial shape of the outer surface of the paper reel, control functions related to operations of the unwinding process are performed.

11. The method according to claim 1, wherein after detecting a local change occurring in the radial shape of the outer surface of the paper reel to be unwound, a flying splice is performed to said paper reel in order to conduct the paper reel and the paper web change at a substantially normal running speed.

12. An apparatus for use in continuous unwinding of a paper web from a paper reel including a core on which the web has been wound, comprising:

at least one member situated adjacent to said paper web being unwound from said paper reel, said at least one member structured and arranged to measure the radial shape of an outer surface of said paper reel in a plane perpendicular to an axis of said paper reel, during said unwinding.

13. The apparatus according to claim 12, wherein said at least one member being arranged to measure the radial shape of the outer surface of the paper reel in a non-contacting manner.

14. The apparatus according to claim 12, wherein said at least one member being arranged to measure the radial shape of the outer surface of the paper reel in a contacting manner.

15. The apparatus according to claim 14, wherein said contacting member touching the outer surface of the paper reel is a roll and a sensor member is arranged to support said roll in a manner that the local change in the radial direction, transmitted from the paper reel to said roll, may be detected.

16. The apparatus according to claim 15, wherein said sensor member is an acceleration sensor.

17. The apparatus according to claim 12, wherein the at least one member includes a first member and a second member, said first member being adjacent to a first end of said paper reel and said second member being adjacent to a second end of said paper reel.

18. The apparatus according to claim 12, wherein said at least one member is a laser measurement device.

19. The apparatus according to claim 12, wherein said at least one member is a microwave radar.

20. The apparatus according to claim 12, further comprises a computer connected to said at least one member, said computer being structured and arranged to conduct a continuous analysis of measurement results and from which information is arranged to be given to a control system of the process on the results of the analysis.

21. The apparatus according to claim 20, wherein said analysis of measurement of results is arranged to contain functions to monitor a condition of the unwinding apparatus according to a vibration measurement principle.

22. The apparatus according to claim 20, wherein said analysis of measurement results is arranged to contain functions to monitor an operational safety of the unwinding device.

* * * * *